United States Patent [19]

Franke

[11] 3,981,280

[45] Sept. 21, 1976

[54] TWO-STROKE COMBUSTION ENGINES

[76] Inventor: Walter Franke, Hittfelder Kirchweg 22, 2105 Seevetal 3, Germany

[22] Filed: Feb. 19, 1974

[21] Appl. No.: 443,922

[30] Foreign Application Priority Data

Feb. 19, 1973 Germany ..... 2308127

[52] U.S. Cl. ..... 123/69 R; 123/71 R; 123/57 B

[51] Int. Cl.[2] ..... F02B 1/08

[58] Field of Search ..... 123/69 R, 71 R, 67, 123/74 AP, 57 B

[56] References Cited

UNITED STATES PATENTS

| | | | |
|---|---|---|---|
| 976,858 | 11/1910 | Easthope | 123/69 |
| 1,083,111 | 12/1913 | MacConaghy | 74/50 |
| 1,378,254 | 5/1921 | MacDonald | 123/57 B |
| 2,000,267 | 5/1935 | White | 123/71 R |
| 2,131,216 | 9/1938 | Brooke | 123/57 B |
| 2,381,832 | 8/1945 | Mansoff | 123/69 R |
| 3,107,659 | 10/1973 | Steinlein et al. | 123/73 V |
| 3,263,412 | 8/1966 | Thompson | 60/303 |
| 3,815,558 | 6/1974 | Tenny | 123/73 PP |

FOREIGN PATENTS OR APPLICATIONS

| | | | |
|---|---|---|---|
| 382,110 | 1/1908 | France | 123/67 |
| 514,799 | 12/1923 | Germany | 123/59 BS |
| 223,985 | 12/1908 | Germany | 123/57 B |
| 255,048 | 9/1927 | United Kingdom | 123/57 B |

*Primary Examiner*—Wendell E. Burns
*Assistant Examiner*—David D. Reynolds
*Attorney, Agent, or Firm*—Toren, McGeady and Stanger

[57] ABSTRACT

A two-stroke combustion engine with intake and exhaust ports which are indirectly or directly controllable in accordance with the reciprocating motion of a working piston in a cylinder space, wherein at one side of the piston there is a working chamber accessible to an ignition device and connectible to an outlet, and at the other side of the piston there is a compression chamber, and wherein there is associated with the working piston at least a second auxiliary piston functioning as a compression piston, which operates in a compression chamber at least in a single acting mode.

7 Claims, 14 Drawing Figures

TWO-STROKE COMBUSTION ENGINES

Figure 1:
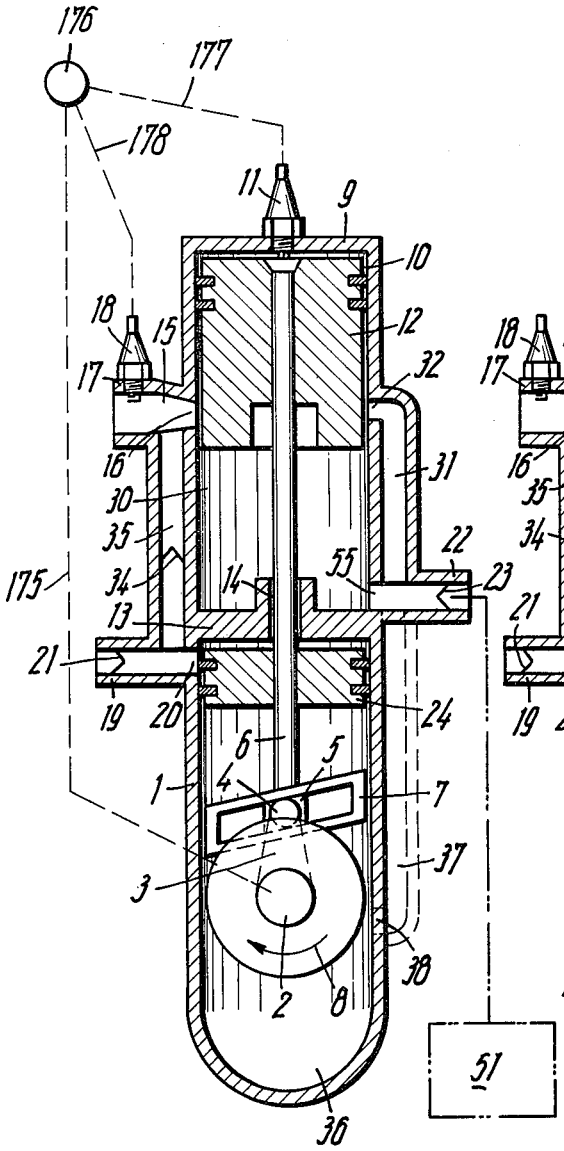

The invention relates to a two stroke combustion engine with intake and exhaust ports, which are indirectly or directly controllable in accordance with the reciprocating motion of a working piston in a cylinder space, wherein at one side of the piston there is a working chamber accessible to an ignition device and connectable to an outlet, and at the other side of the piston there is arranged a compression chamber.

In known constructions the compression chamber is formed at the side of the piston other than the crank case side at which the piston enters.

Furthermore the invention relates particularly to an engine in which the pistons, which may be connected to piston rods, cooperate, through the intermediary of a crank guide, with the crank pin of a driven output shaft. Crank guide driving arrangements are already known having crank guides directed normal to the piston rod, the crank pin rotating in the crank guide. Such arrangements produce problems in suppressing the dead point. Furthermore in such constructions there always exists the same stroke characteristic between the working stroke and the suction stroke.

Furthermore the invention relates particularly to an engine which combines a plurality of cylinder and piston arrangements in a particular manner. In two stroke combustion engines it is already known to provide a plurality of cylinder and piston arrangements either of in-line, or V formation or even to provide a radial arrangement in stationary engines similar to that used for combustion engines for other purposes. The purpose of the angular formation of a plurality of cylinder and piston arrangements is to enhance the smooth running.

The invention takes as its basic purpose the improvement of a two stroke combustion engine of the above described type in respect of obtaining an increased power output and/or an improved degree of combustion of exhaust gas as compared with known engines with comparable volume of working space. In particular, in a construction using a crank guide the power output is to be improved by a particular construction of the coupling means between the crank pin and the piston rod, and furthermore an engine is to be provided by virtue of whose construction positional stability is achieved with exceptionally smooth running during operation without additional measures being adopted.

The basic problem is solved in that there is associated with the working piston at least a second auxiliary piston functioning as a compression piston, which operates in a compression chamber at least in a single acting mode. By the arrangement of a second piston the possibility is surprisingly created either of supplying compressed air for super-charging or for improving the combustion of the exhaust gas, or of additionally compressing the mixture.

In one practical form of the invention the second piston, or compression piston, is arranged coaxially with respect to the working piston upon the same piston rod. In this way a simple structural form is achieved, which is to be realised in an upright cylinder and piston arrangement, possibly also comprising a plurality of such cylinder and piston arrangements, but which also opens up the possibility of providing further variants which are particularly advantageous solutions of the problem.

According to a further form of the invention the second piston, or compression piston is guided in a separate cylinder space and is controlled by the same driving crank as is the working piston, in which case the cylinders for the working piston and for the second piston are connected together. This construction is of particular advantage if a solution is being sought for in which the exhaust gas is to be delivered in a consumed and purified form by utilising its inherent energy, whilst at the same time this solution is advantageous for meeting the additional demand according to which the running stability is to be improved, in particular in the case of a vehicle.

A preferred construction is that in which the working piston and the second or auxiliary piston have different cross sections.

Particularly favourable results are achieved if the second piston or compression piston is provided so as to function in a double acting mode. In this case a particularly favourable construction is realised if the additional, that is to say the second or compression piston, is provided in a cylinder space closed by end walls. However, this arrangement also involves the fact that one side of the second, or compression piston cooperates with the crank casing. By this means it is possible to reduce the structural height of a cylinder and piston group.

According to the increased introduction of compressed air or compressed mixture there are provided between the different chambers, which are associated with the pistons, connecting ports controlled by valves or pistons. According to one advantageous arrangement, in addition to the working chamber, there are also provided at least a compression chamber for the mixture and at least a compression chamber for the air. Also advantageously included in this arrangement is a compression chamber for air which is directly connectable with an exit duct from the working chamber, in which exit duct there is arranged a spark plug. By this means the after burning in the exit duct is substantially improved.

According to another construction a spark plug is provided in a compression space of the associated second or compression piston, in which case this compression space is connectable with the working chamber of the working piston, and receives the exhaust gas, preferably with air enrichment, and furthermore, this second or compression piston executes a working stroke after compression and ignition of the exhaust gas. Thereby further power is produced whilst achieving the object of purifying the exhaust gas and effecting additional combustion thereof. The inventive concept embodied in this arrangement with a second or compression piston is particularly advantageous because the working piston performs in the known manner simply its compression and working stroke with the particularly favourable power utilisation for two stroke engines without it being necessary to have additional intermediate strokes for the combustion of exhaust gas. By the adoption of the invention the normal working cycle is reinforced in respect of power output by the additional combustion of the exhaust gas.

A particularly advantageous form of the invention has a three-chamber design, in which one chamber is arranged above the working piston, a suction chamber below the working piston, and a further compression chamber between the second or compression piston and the intermediate wall, and the chambers are so interconnected that compressed mixture or compressed air is produced in two chambers. Furthermore an advantageous embodiment comprises three chambers for compressing the air, at least a substantial portion of which can be fed into the working space, and in the working chamber a valve controlled intake port for mixture is provided at a level above the working piston, when the latter is at its lower reversal point. In this arrangement it is appropriate to provide a valve controlled intake port for air in the suction space immediately above the intermediate wall.

Another particularly advantageous embodiment of the invention has a four-chamber design, wherein the one working chamber is arranged above the working piston, a suction chamber is arranged between the latter and the intermediate wall, a third chamber is arranged between the latter and the compression piston, and a fourth chamber is provided at the other side of the compression piston, and valve controlled connecting ducts are arranged between the chambers and, if necessary, the outlet. This provides the possibility of achieving a particularly marked increase in power output or cleaning of exhaust gas whilst employing only one additional piston, in which case it is of particular importance that practically no additional space is required if, as is appropriate, the fourth chamber is formed by the crank casing.

In order however to make it possible to fulfill all conditions, and in particular to avoid any unwanted influences from a chamber formed by the crank casing, where it is necessary to have lubrication, a further advantageous embodiment provides that the fourth chamber is separated from the crank casing by a second intermediary wall.

A further particularly advantageous embodiment of the invention is characterised by the feature that an outlet port which is opened by a working piston situated in the lower reversing point, is connected through a connecting duct to a first intake for air, which intake leads into the compression space of the second piston, whilst in the connecting duct and the intake there are arranged respective valves, of which the first leads to the outlet, and the latter to the connecting duct and to a port leading into the said compression space, and that a second inwardly opening valve controlled intake for mixture is connected through a connecting duct to the working chamber, through a port above the working piston when the latter is situated in the lower reversal point, and through a port with the suction chamber. This embodiment can in particular be improved by arranging that the connecting duct between the second intake and the working chamber is connected to a crank casing chamber through an extension section. In this way is achieved the transition to a four-chamber system.

If it is intended to use an exceptionally compressed mixture, it is appropriate to arrange an intake port for mixture in the suction chamber near to the lower side of the working cylinder when the latter is at the upper reversal point.

When including the crank casing chamber, the functioning is improved, if the latter is adopted for the additional compression of a medium, if the overflow duct at the second intake for mixture has a port leading into the crank case chamber, and the second or compression piston is provided with a skirt having a port which opens the cylinder wall port of the connecting duct only at the lower reversal point of the compression piston, so that the so-called third chamber for air is relieved through a valve into the connecting duct when excess pressure exists in said third chamber. Whilst it is here observed that a plurality of chambers are provided for air compression and that the compressed air is fed into the working chamber or else is conducted to the output port fitted with an additional ignition device, it is also to be understood that by employing the features of the described arrangement a plurality of chambers may if preferred be adopted for the precompression of the mixture so as to achieve an exceptional increase in the power output in the working chamber.

In one construction, the fourth chamber connected to the second intake is shut off by the intermediate wall, and compressed air is feedable from the third or compression chamber into the connecting duct.

According to a further particular embodiment both the working piston as well as the second or compression piston operate in the double acting mode, and at one side, at which both the cylinder spaces are in communication with each other said pistons function as air compression pistons, working in air compression chambers, both of which air compression chambers are interconnected, and in the workig cylinder a connecting duct is provided in the working space, which is opened when the pistons are situated in the region of their lower reversal point, and at least one further connecting port; in particular a piston controlled connecting port, is provided for the other cylinder chambers, which connecting port is opened substantially at the piston lower reversal point.

Whilst adopting the main features of the above described embodiment, a particular solution according to the invention provides for the creation of special motion characteristics between the working stroke and the suction stroke by the use of a crank guide by arranging that the crank guide has its direction inclined with respect to the piston rod and that a different stroke characteristic is present between the working stroke and the suction stroke. In such an arrangement it is preferred that the crank guide, as referred to the rotation direction of the crank pin in forward motion, is always inclined upwardly from the circle of rotation of the crank pin, or, in the case of an engine rotor embodiment, is always inclined upwardly with respect to an imaginary circle of the engine rotor rotation. By this means the working stroke is utilised in a particularly intensive manner so that strong driving impulses are produced. Moreover the inclined crank guide results in a displacement of the reversal points of the piston, or pistons, as compared with a construction having a crank guide which is directed normal to the piston rod.

Whilst the previously described arrangements may be put into practice as stationary in-line formations in various ways or stationary radial arrangements, a further improvement over these may also be obtained by an arrangement in which a plurality of cylinder and piston arrangements are positioned radially and adjacent each other in one plane with respect to one or more central crank pins to constitute an engine rotor, which is mounted normal to the driven output shaft in a stator. In this way there is produced a rotary unit in which the control of the different chambers is facilitated in that the intake and exhaust can be closed in dependence upon the rotation movement. It is particularly preferred however to use the rotating disc shaped engine rotor as a gyro for stabilizing a vehicle for land, water or air travel, in which case there will be at least four cylinder arrangements, possibly multiple cylinder arrangements, arranged in a single plane. Included in the practical applications is an arrangement of the disc shaped engine rotor on a horizontal or vertical axis in a vehicle. The arrangement with the horizontal axis in land vehicles can be particularly advantageous for stabilization. When used in water borne craft the arrangement upon a vertical axis provides a particularly favourable degree of stabilization to counteract the movements which would otherwise be caused by travel through water. This allows the possiblility of avoiding capital expenditure on the already known systems for ship stabilization involving the use of auxiliaries which, in particular, require to be separately driven and controlled, because this purpose can now be satisfied by the ship's driving engine. This solution of the problem using a disc shaped engine rotor operating as a gyro is not restricted to the use of a two stroke combustion engine, because a four stroke machine or a Diesel engine could also be adopted for the same purpose.

In this type of solution it is preferred that alternate cylinders should have different cross sections and that adjacent cylinders be connected together.

The invention will now be explained with reference to practical examples shown in the accompanying drawings.

Figure 5:
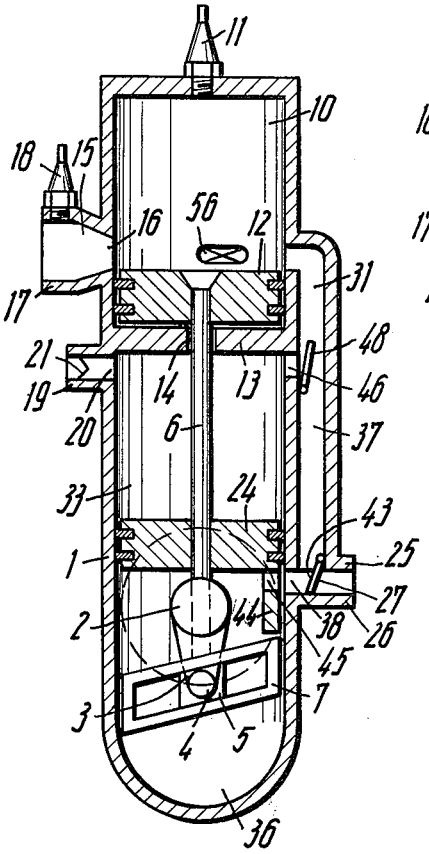
Figure 6:
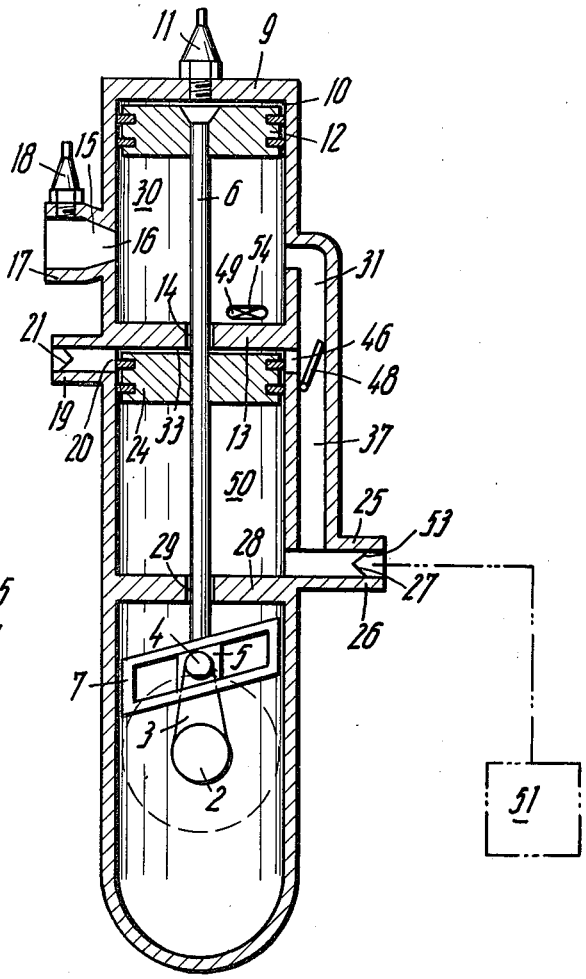
Figure 7:
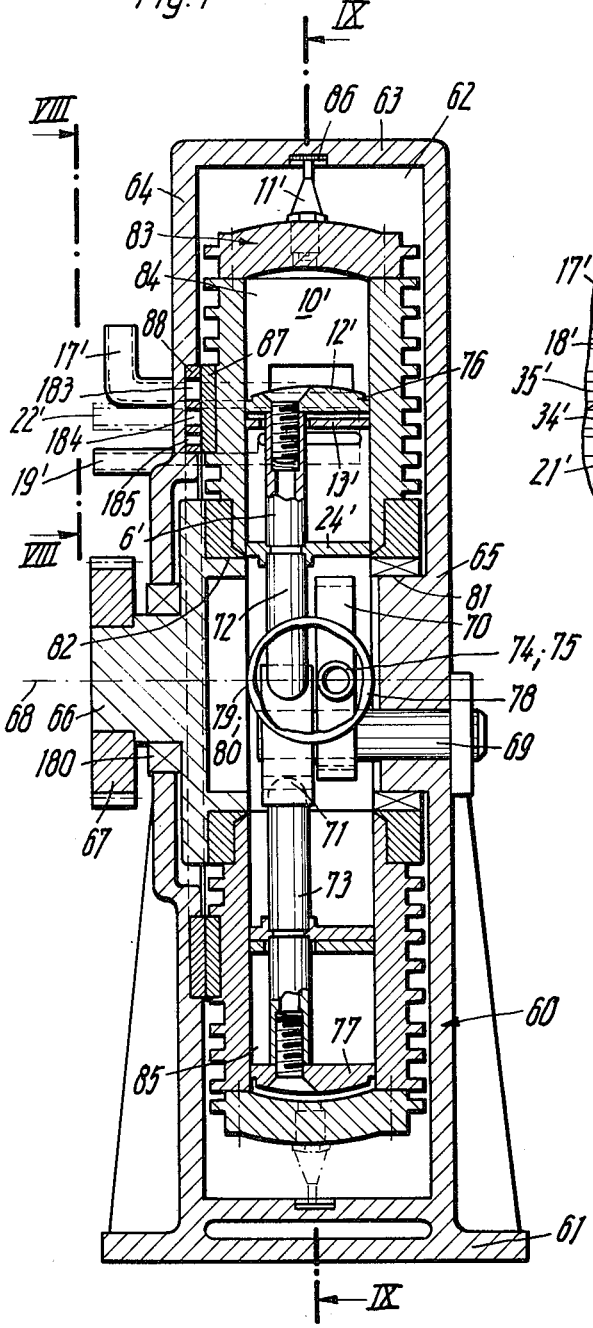
Figure 8:
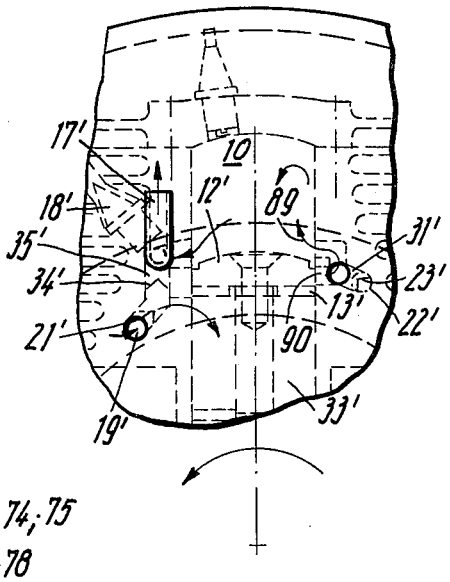
Figure 9:
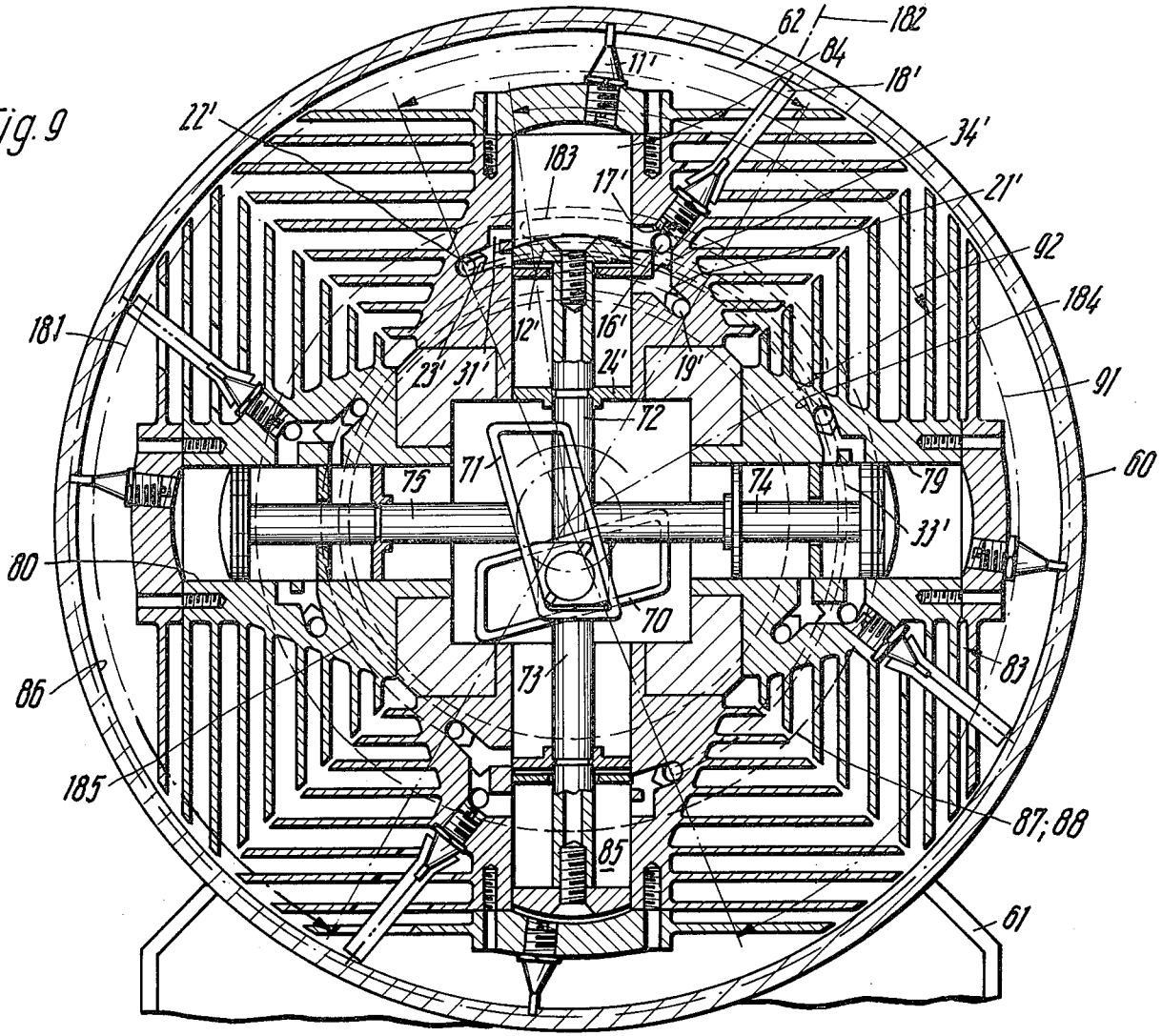
Figure 10:
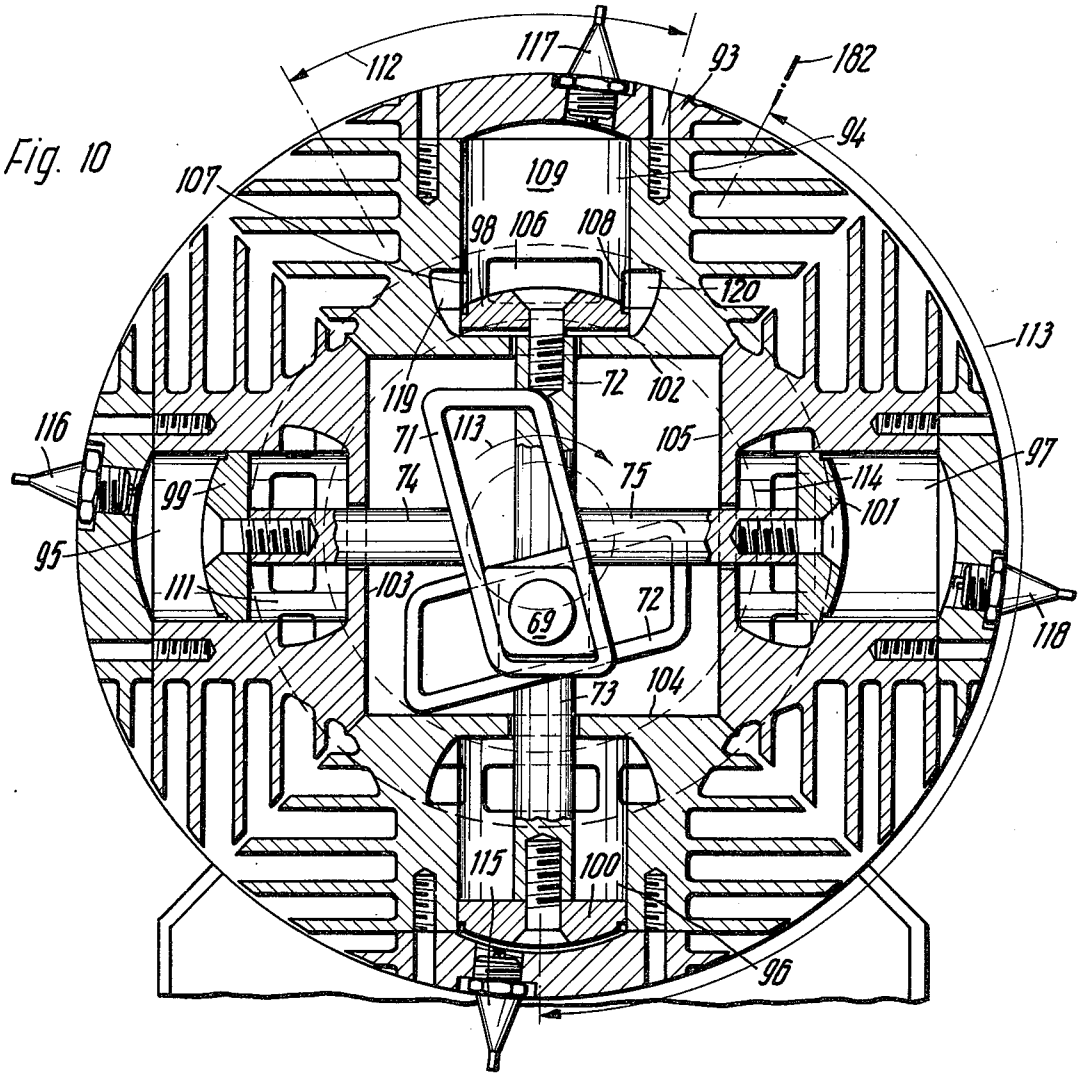
Figure 11:
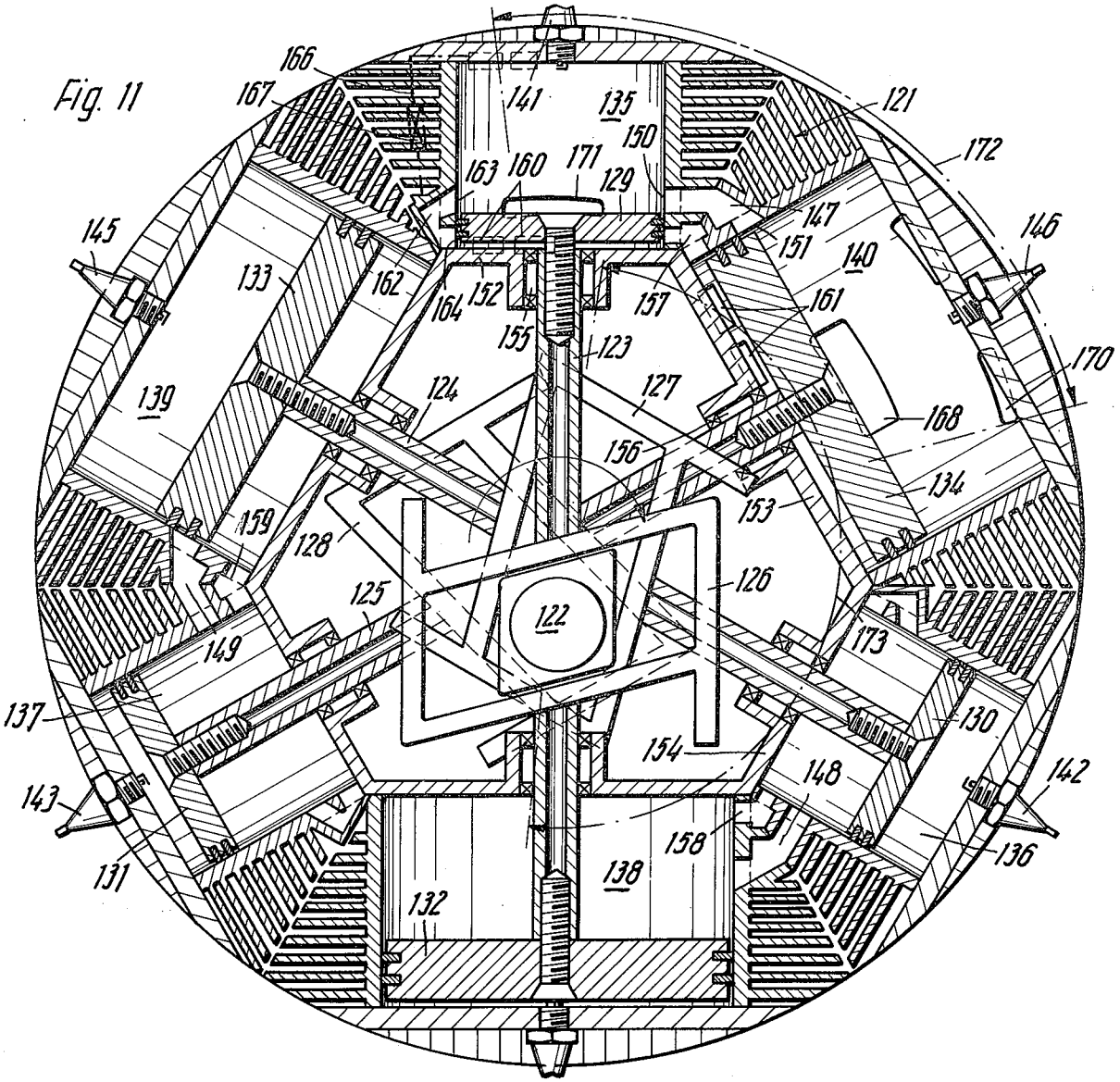

The drawings show in each case substantially schematic views of two stroke engines, without any implied restriction to this type of engine in all the practical forms of the invention. In the drawings:

FIGS. 1 to 6 show stationary, cylinder and piston arrangements, including single cylinder arrangements, according to the invention, FIGS. 7 to 9 show a variant from FIGS. 1 to 6 in a construction of a rotating cylinder and piston arrangement as an engine rotor, FIG. 10 shows another construction of an engine rotor corresponding to FIG. 9 but shown only partially, FIG. 11 is a corresponding representation of a further construction, also in the form of an engine rotor, but including a distribution over adjacent cylinders of mutually associated working pistons and compression pistons taking part in a working cycle.

Figure 2:
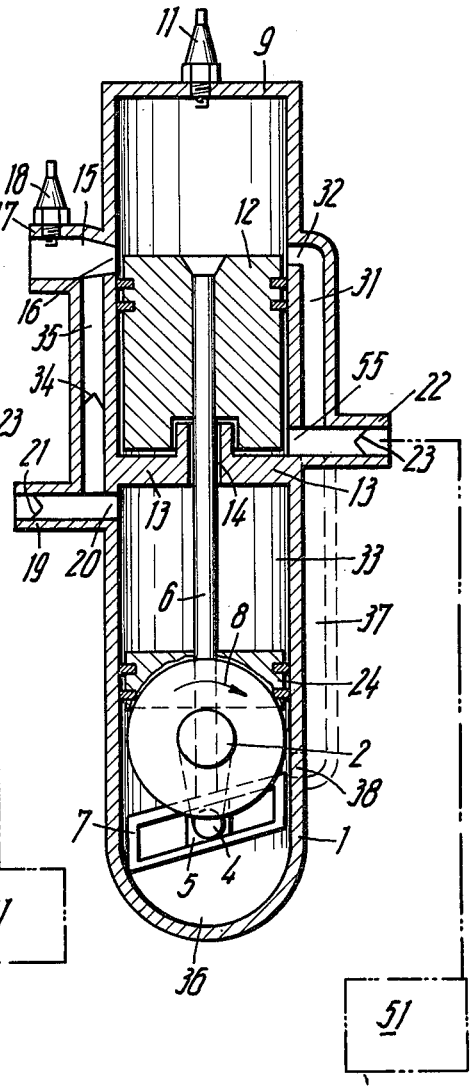
Figure 1A:
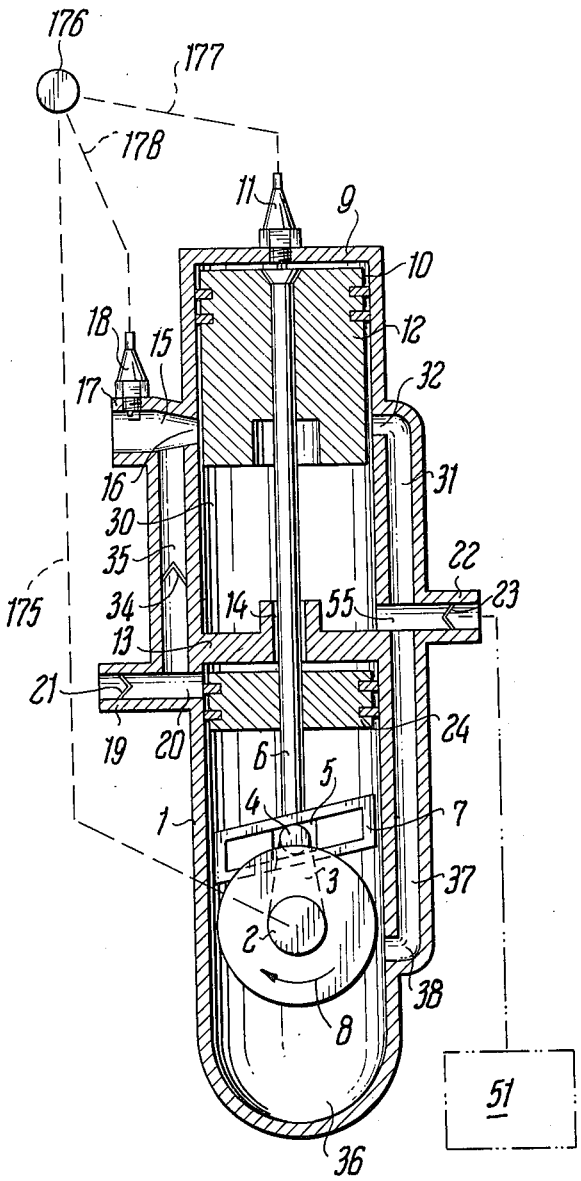
Figure 3:
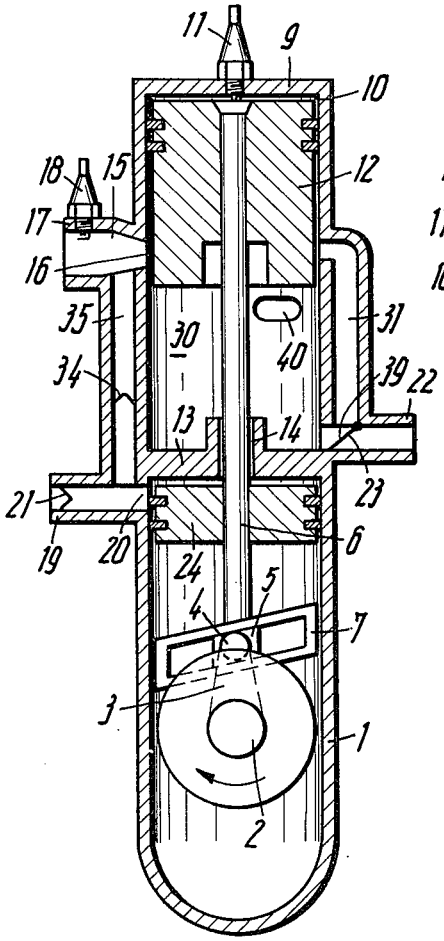
Figure 4:
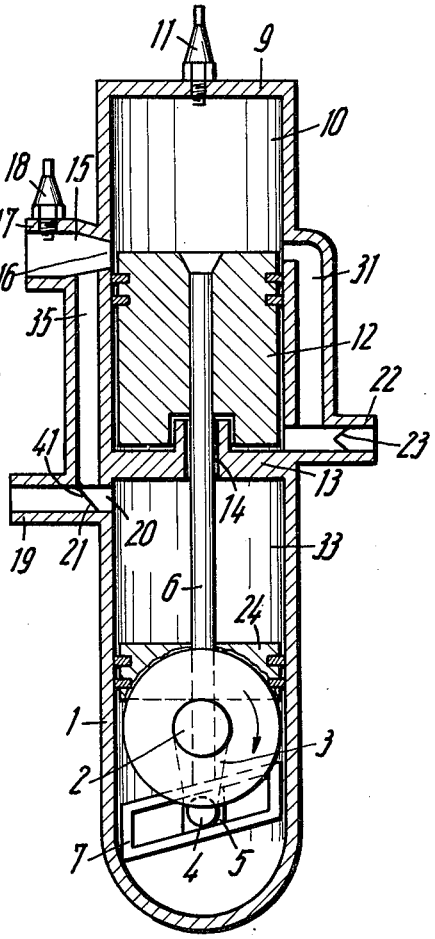
Figure 12:
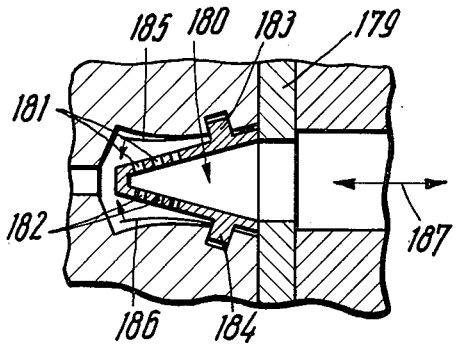
Figure 13:
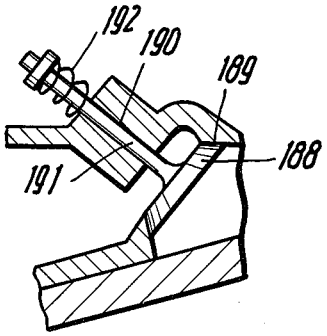

The individual content of the drawings is as follows:

FIG. 1 is a practical form which, in particular, partakes of after burning, and at the same time in one practical form makes possible good supercharging of the working space, FIG. 1A shows a modification of the embodiment of FIG. 1, FIG. 2 shows the practical form of FIG. 1 in a different working position, FIG. 3 shows a practical form of the engine corresponding to that in FIG. 1, wherein additional air enrichment is effected for the working stroke, FIG. 4 is the practical form according to FIG. 3 in another working position, but showing a modification in respect of the valves, FIG. 5 is a practical form having precompression of the mixture and fresh air scavenging in the outlet, FIG. 6 shows a further practical form with an additional chamber system, in which additional fresh air scavenging takes place in the outlet, FIG. 7 is an engine construction with a cylinder and piston arrangement of the type shown in FIGS. 3 and 4, but adapted to operate as an engine rotor, FIG. 8 is a view along the line VIII—VIII in FIG. 7, FIG. 9 is a side elevation of the motor according to FIG. 7 in section along the line IX—IX of FIG. 7, FIG. 10 is another practical form of the engine rotor corresponding to FIG. 9 shown in cross section, but particularly suitable as a stabilizing gyro, FIG. 11 is a view corresponding to FIG. 10 of another engine rotor, that is to say omitting the casing, wherein again a gyro function of the engine rotor can be achieved, but using also in principle a parallel arrangement of mutually associated cylinder and piston arrangements each having a working piston and a compression piston, FIGS. 12 and 13 are detail sections of valve constructions which are employed.

In all the figures there are represented only those components which are essential for explaining the functioning of the invention, equivalent components being pointed out in each case, in particular when comparing the embodiment of FIGS. 3 and 4 on the one hand with that of FIGS. 7 to 9 on the other hand.

In referring to FIGS. 1 to 6 it is to be observed that these figures show in each case a central section through a two stroke engine, the plane of the section lying normal to the crank rod and cutting one piston arrangement, although it is to be observed that multi-cylinder machines are also included having a conventional arrangement of a plurality of such cylinder arrangements with an in-line formation normal to the plane of the drawing, which formations may, if necessary, also be arranged displaced with respect to one another in a V formation.

In FIGS. 1 to 6 all equivalent parts are indicated by the same reference characters.

The lower part of the cylinder casing 1 is penetrated by the crank shaft 2 carrying the crank 3. The crank pin 4 is guided in a block 5 which is of rhomboidal shape and which reciprocates in a crank guide 7 fixed to the piston rod 6 and obliquely inclined thereto. The oblique arrangement of the crank guide and the slot provided therein has the result of facilitating the suppression of the dead point because, due to the straightening out of the piston rod 6 and the crank 3 under load a lateral component is exerted upon the crank guide, but there is also produced a special type of characteristic in respect of the stroke movements of the piston so that, according to the inclination of the crank guide, the beginning or end portions of a piston stroke will take place in opposite phased directions quicker than the other portions of the piston stroke movements. When using the indicated inclination of the crank guide 7, which is the preferred one, and assuming a direction of rotation in the sense of the arrow 8, there will take place a more rapid initial downward movement of the piston rod 6 as compared with operation with a crank guide arranged normal to the direction of the piston rod, so that a particularly effective utilization of the working stroke is achieved. This characteristic is important for the various suction and expulsion strokes of the pistons provided in the arrangement.

The cylinder case has in its upper wall 9, which closes the so-called operating chamber 10, a spark plug 11, which is fired in a known manner before each working stroke. To the piston rod there is secured a working piston 12, above whose top surface is arranged the working chamber 10. Below the bottom dead centre position of the piston 12, shown in FIGS. 2, 4 and 5, the cylinder casing has a first intermediate wall 13, having a bore 14 for the piston rod 6. Within the bore there are known types of guiding and sealing means not shown in the drawing.

In the cylinder casing there is an outlet 15 provided with a port 16 so placed in the cylinder casing that the port 16 is opened when the working piston 12 is situated at its bottom dead centre position. In the outlet pipe 17 there is provided a second spark plug 18, which is fired at the correct point of the working stroke for after burning of the exhaust gases leaving the outlet. For example there is indicated in FIG. 1 a drive connection 175 from the crank shaft 2 to a distributor 176, whereby the spark plugs 11 and 18 are operated in the correct part of the working stroke through lines 177 and 178.

It is furthermore to be understood that other known means, for example a starter, are connected to the crank shaft 2 of the engine. Corresponding arrangements are also provided in all the other embodiments as is well known to the person skilled in the art.

Thus it will be understood, for example according to FIG. 7, that a drive connection, corresponding to the drive connection 175, can be operated from the output drive pin 66. Correspondingly also in the embodiments according to FIGS. 1 to 6, there may be provided upon the crank shaft 2, or upon an extension of the end thereof, a driving member in engagement with further driving gear.

In the embodiments according to FIGS. 9 to 11 there is provided an arrangement corresponding to that in FIG. 7, i.e. the rotating cylinder body controls the spark plugs in the manner prescribed and carries a driving member for engagement with a gear, for example that of a vehicle.

Furthermore below the first intermediate wall 13 a first intake 19 has a port 20 leading into the cylinder casing. This intake has a valve arrangement 21 which opens inwardly, that is to say towards the cylinder casing, but which can be constructed in a variety of ways. Further reference is made to this in the particular description of the various figures of the drawings.

In the embodiments according to FIGS. 1 to 4 a second intake 22 is so arranged that it leads into the cylinder casing above the first intermediate wall. This second intake is likewise provided with a valve arrangement 23, which can also be constructed in various ways, but which always opens towards the interior of the cylinder casing and is blocked in the outward direction.

In each embodiment at least one second piston is provided on the piston rod, this being a so-called compression piston 24, which, like the first mentioned working piston 10, can be fitted with guiding means or piston rings or the like. At the upper dead centre position this compression piston 24 closes the first mentioned intake 19.

In FIGS. 5 and 6, instead of the second intake 22 of FIGS. 1 to 4, there is provided a second intake 25 spaced below the first intermediate wall 13. The pipe 26 of the second intake is provided with a valve arrangement 27, which can be constructed in various ways, but which as above described always opens inwardly.

It is observed that according to FIG. 6 there is provided a second intermediate wall 28 having a bore 29 with guiding and sealing means for the piston rod 6, this intermediate wall being so positioned that in this embodiment the compression piston 24 in its bottom dead centre position is situated directly above the second intermediate wall 28.

The various embodiments will now be described in more detail beginning with FIGS. 1 and 2. In FIG. 1 on the assumption that the mechanism is shown before a working stroke and at the instant of firing of the spark plug 11, it is evident that suction chamber 30 between the working piston 12 and the first intermediate wall 13 will be charged with a mixture from the mixture source 51 through the second intake 22, the inwardly opening valve arrangement 23, and the cylinder wall port 55, this mixture being sucked through the intake pipe 22, which is suitably connected to the source 51. In the operating stroke the mixture is compressed in the suction chamber 30 and, when the working piston 12 reaches the position in FIG. 2, the working chamber 10 is filled with this mixture through an overflow duct 31 having a port 32, whereby the inflowing compressed mixture at the same time scavenges the working chamber 10 and conveys the exhaust gases through the port 16 in the exhaust pipe 17. In the working stroke of the working piston 12 the compression piston 24 descends. The so-called third chamber 33 positioned above the compression piston 24 sucks air through the port 20 and the first intake 19. In the upward movement of the piston this air is compressed whilst escape thereof is prevented by the valve arrangement 21, which only opens inwardly, but compressed air is fed through a connecting duct 35 to the exhaust pipe 17. In this connecting duct there is provided a valve arrangement 34 which opens towards the exhaust pipe 17. Thus in the upward movement of the piston directly compressed air is conveyed to the exhaust pipe, so that the exhaust gases are enriched with oxygen so that in the subsequent firing of the spark plug 18 a satisfactory after burning takes place.

FIGS. 1 and 2 show also a further embodiment for a so-called four-chamber system, in which in addition to the working chamber 10, the suction chamber 30 and the so-called third chamber 33, there is also provided a fourth chamber 36, known per se, the so-called crank case chamber which is situated therefore underneath the compression piston 24. In this embodiment the overflow duct 31 is extended downwardly into the fourth chamber. The extended portion, which is indicated schematically at 37 in FIGS. 1 and 2 and in solid line in FIG. 1A terminates at a port 38 in the crank case. In this embodiment, simultaneously with the enlargement of the suction chamber 30, mixture is sucked into the crank casing through the intake 22 so that when the port 32 is opened the working chamber 10 receives compressed mixture from two chambers 30, 36, these being the suction chamber 30 and the crank case chamber 36, as a result of the reciprocation of the compression piston 24. By this means an increase in output power is achieved, made possible by the inventive principle of the double piston, although in this arrangement there also takes place compression of the air in order to promote after burning at the exhaust.

Also included is an arrangement in which the crank casing chamber 36 is utilised as an air compression space, and wherein by means of a connection, not shown in the drawing, to the exhaust pipe 17, a valve is arranged to be controlled in such a manner, for example by the crank shaft, that this valve opens at a point in the working cycle shortly after the lower dead centre point of the piston arrangement is reached, in order thereby to achieve an enhanced oxygen enrichment in the exhaust.

The construction according to FIGS. 3 and 4 resembles in respect of its machine structure that according to FIGS. 1 and 2.

However the valve arrangement 23 according to FIG. 3 does not consist of a non-return valve or membrane valve but a flap valve which can assume two positions. The indicated position of the flap valve 39 in the drawing creates a connection between the compression chamber 30 and the overflow duct 31, which is appropriate after passing through the upper dead centre point of the working piston 12. Upon the expulsion stroke of this working piston 12 the flap valve 39 blocks the connection duct 31 so that the mixture is sucked only into the compression chamber 30 through the intake 22.

In this embodiment in which the connection duct 31 is closed during the filling of the suction chamber 30, and a separate intake opening 40 for mixture is arranged in the suction chamber 30 close to the lower side of the working piston in the upper dead centre position, the possibility is offered that air drawn in through the second intake 22 can possibly enrich with oxygen the mixture fed through the port 40, for example through a compressor. In this way an increase in power output can be achieved.

The valve arrangement at position 20 in FIG. 4 is designed in a similar manner, for example, as a flap valve 41. 39 and 41 may also be designed in other ways as two-way valves. When air is sucked into the third chamber 33 the connecting duct 35 is blocked. By employing in this embodiment such a two-way shut-off valve, for example, the two-way valve 41 (the flap valve 39 is also indicated as a two-way valve) a compression of the drawn in air can take place until the compression piston 24 again ascends and overcomes the internal pressure in the so-called third chamber 33. Upon increase in volume of the third chamber 33, the flap valve 41 turns over automatically because the provision of the valve arrangement 34 in the connecting duct takes care that a drop in pressure takes place when the chamber is being emptied and air admission takes place through the pipe 19.

A further solution will now be described with reference to FIGS. 3 and 4. In this solution there still remains the feature that air is sucked in through the first intake 19. In a particular embodiment in which an intake port 40 for mixture is provided which is controlled by the working piston 12 close to its upper dead centre position, there is also included the provision of the second intake 22 for drawing in air. In this case, when the lower dead centre position of the working piston is reached, a mixture enriched with compressed air will flow into the working chamber 10 through the connection duct 31 and would contribute to the expulsion of the gases as well as enriching the exhaust gases with oxygen. The working piston has the height necessary for controlling the ports. This height is greater in FIGS. 1 to 4 than it is in FIGS. 5 and 6.

FIG. 5 shows a four-chamber solution (see FIGS. 1 and 2 with the extension section 37 for the overflow duct). The overflow duct 31 and its extension section 37 are also indicated with the same reference characters in FIG. 5, but in this particular embodiment the intake 25 is arranged in the region of the place where the port 38 of the duct 31, 37 leads into the crank case chamber 36, and furthermore the valve arrangement 27 is designed as a two-way or flap valve 43. In this embodiment a skirt 44 is provided upon the compression piston, which covers the port 38, but which has a port 45 immediately below the compression piston so that the port 38 is only open when the piston reaches the lower dead centre position.

In this embodiment an outlet port 46 leads from the third or compression chamber 33 into the overflow duct 31, 37. This outlet port 46 is so controlled by a valve 48 that in the case of an excess pressure in the chamber 33 communication is established through the overflow duct 31 to the working chamber 10, but in the case of a drop in pressure in the chamber 33 the entire overflow duct 31, 37 is open. In this way, due to the opposing action in the third, or compression chamber 33, and the fourth, or crank case chamber 36, in the case of shutting off the third or compression chamber 33 and the opening of the entire overflow ducts 31, 37, the port 38 for the chamber 36 is in any case open in the region of the lower dead centre position.

With this embodiment if mixture is drawn in through the second intake 25, this is precompressed in the crank case chamber 36 and conveyed into the working chamber 10 in the region of the lower dead centre position. The air sucked in through the first intake 19, which is compressed, is released into the connecting duct 31 in the region of the upper dead centre point of the piston arrangement upon opening of the valve arrangement 48 and closing of the connecting duct extension 37, and this compressed air flows as scavenging air into the exhaust 15 before the compressed mixture, by reason of the pressure relief in the chamber 33 and the closing of the valve arrangement 48, can flow out of the crank case chamber 32 into the working chamber 10, when the working piston 12 is in the lower dead centre position.

FIG. 6 shows a solution which differs from the previously described embodiments in that the second intermediate wall 28 is provided. In this embodiment the valve arrangement 27 in the intake pipe 26 is designed as a membrane valve or a one-way valve 53. The compression chamber 33 is again connected to the two branches 31, 37 of the overflow duct by means of the two-way valve 48. This embodiment operates correspondingly to FIG. 5, in that namely it is only the pressure difference in the sections 31, 37 of the overflow duct at both sides of the valve arrangement 48 which is the determining factor for the valve positioning or functioning. In this embodiment it is advantageous to provide immediately above the first intermediate wall 13 a further intake 49, which has an inwardly opening non-return valve 54.

Starting from the position of FIG. 6 it is seen that a working stroke follows. First of all compressed air was blown out of the third or compression chamber 33 through the compression chamber 30, whilst in the range of the suction stroke air could be sucked through the intake 49 under the working piston 12. By this means a particularly intense enrichment of the exhaust gases takes place, the more so because upon the downward stroke of the working piston 12 this air is intensified and driven through the outlet 15 for after burning. Then the valve arrangement 48 closes the overflow duct 31. At the same time there takes place the suction of air through the first intake 19. After a certain part of the downward stroke the sucked in mixture is sufficiently compressed in the fourth chamber 50 between the second intermediate wall 28 and the compression piston 24 in order that it can be forced into the working chamber 10 above the working piston 12, which in the meantime has reached the lower dead centre position.

If, in the cylinder wall in the region of the chamber 10, there is arranged an intake port 56 for mixture valve controlled by the working piston 12, but which is only opened when the working piston 12 is situated in the region of its lower dead centre position, then it is also possible for air to be sucked in through the second intake 25, this air causing oxygen enrichment of the mixture in the working chamber 10 and thus contributing to increase of power output.

Referring to FIG. 3 on the one hand and FIGS. 5 and 6 on the other hand it is to be observed that the ports 54 and 56 leading into the working chamber are specially controlled by valves if a short length piston 12 is employed, whilst in the case of a long piston according to FIG. 3, the piston itself can assume the function of control in combination with the necessary arrangement of piston rings.

FIGS. 7 to 9 show a modification upon the already described FIGS. 3 and 4 having an engine rotor, in which radially arranged cylinder and piston arrangements operate in phase opposition, each two of these being positioned opposite each other and connected by means of the crank rods and crank guides. Starting from the embodiment according to FIGS. 7 and 9 it can be seen that an engine stator 60 is provided with a frame 61, which at its central region has a cylindrical internal cavity 62, which is bounded by the peripheral wall 63 and two side walls 64, 65. In the side wall 64 there is centrally arranged a bearing arrangement 180, which carries upon its extended drive shaft 66 a driving element, for example a gear wheel 67. In the other side wall 65, eccentrically to the axis 68 of the output drive shaft 66, there is mounted a crank pin 69. The crank pin 69 engages at its inner end in two crank guides 70, 71, which respectively are arranged oblique to the appertaining piston rod arrangement 72, 73 and 74, 75 respectively. In FIG. 7 it can be seen that the piston rods 74, 75 on the one hand and 72, 73 on the other hand extend adjacent to each other, so that the crank guides must also be arranged adjacent each other. For this reason the piston rods 72, 73, as can be clearly seen in FIG. 7, are arranged eccentrically upon the pistons 76, 77, whilst in the case of the piston rods 74, 75, an equivalent arrangement can be seen through the outline 78 of the cylinders 79, 80.

Within the stator 60 the engine rotor 83 is arranged upon inwardly directed bearing supports 81, 82 by means of special bearing means. It has four cylinder bores 84, 85 and, in the manner already mentioned, 79 and 80 are mutually displaced through 90°. The cylinder bores are in each case penetrated by intermediate walls. It is to be observed that the description now follows with reference to the upper part of FIG. 7 and the upper part of FIGS. 8 and 9 because all of the cylinder and piston groups are the same. In order to explain the functioning in comparison with FIGS. 3 and 4, corresponding components in the present embodiment are indicated by the same reference characters as in FIGS. 3 and 4 but with the addition of a dash. The piston otherwise indicated by 76 can, in view of this, be indicated by 12'. As compared with the piston rod 72, this piston is also mounted upon the piston rod 6'. Upon the latter there is also arranged the compression piston 24'. The cylinder space is subdivided by the intermediate wall 13', which is penetrated by the piston rod 6'. In the cylinder bore 84 the working chamber 10' is arranged at the outer side of the working piston 12', the ignition device 11' leading to said working chamber 10'. The outer end of the ignition device 11' as well as the connections of the ignition devices 18' extend to a contact strip 86 at the inner side of the peripheral wall 63 in order that in each case firing may take place at the correct instant. The firing is effected in accordance with FIG. 9 substantially in the downwardly directed position.

The connections are in this embodiment controlled through superimposed slip rings 87, 88, which are shown in FIG. 7, of which, for example, 88 is arranged in the side wall 64 and the other 87 is arranged in the engine rotor 83. In these slip rings there are openings which overlap in a manner which is not further described in detail.

As shown, in particular from FIG. 8, there is arranged an exhaust pipe 17', in which there is provided a second spark plug 18' (FIG. 8). A duct 35' with the valve 34' leads into this exhaust pipe. This duct is in communication with the first intake 19'. This intake, in which is arranged the valve 21' leads into the so-called third chamber 33' below the intermediate wall 13'.

Furthermore the second intake 22' is provided, which, according to FIG. 7, is also directed outwardly, and in which is arranged the valve 23'. The connection with the space 10' is created in accordance with the arrow 89 through the duct 31', whilst, also according to FIG. 8, the duct section 80 is provided so as to feed into the compression space 30 between the piston 12' and the intermediate wall 13'. Thus is described in principle the function of the embodiment according to FIGS. 7 to 9 because this function corresponds to that of the embodiment according to FIGS. 3 and 4. It is to be remarked that the arrangement of the slip rings 87, 88 is implied in FIG. 9, from which it is to be understood that in the slip ring 87 in the engine rotor 83 the outwardly directed apertures 20' are arranged corresponding to 20 and corresponding to the connection 22'. The exhaust port 16' leads into the duct 15'. With reference to FIG. 9 it is observed that by the slip rings 87, 88 the intake 19' is opened in a range corresponding to the arrow 181, which is possible by arranging the overlapping of a slot and a port. Thus, with rotation in the indicated direction corresponding to the arrow 181 air can be sucked into the expanding space between the intermediate walls 13' and the compression piston 24'.

The second intake 22' is open corresponding to the arrow 91, i.e. suction of mixture is possible in this range. The extent of the slot shaped ports can be seen in FIG. 9. In this way the suction space 30', corresponding to 30 in FIGS. 3 and 4, is filled. The overflow duct 31 is indicated by 31' in FIG. 9.

The exhaust 17 with the port 16' is open over the angular range 92. It is to be seen from FIG. 9 that the individual exhaust ducts 17', 22' and 19' are arranged at various radial distances from the centre of the engine rotor so that the slots 183–185 necessary for control can be arranged adjacent one another in the slip ring 88 of the stator.

It is to be understood that between the adjacent running slip rings 87, 88 sealing means are arranged which separate from each other the tracks of the slots according to FIG. 9. In FIG. 7 the slots are shown in cross section.

The embodiment according to FIGS. 7 to 9 provide an engine rotor in the form of a gyro, which, by virtue of its rotation, not only provides automatic control of valves or ports in dependence upon its revolution, which makes the construction robust and simple, but also introduces special stroke characteristics as a result of the crank guides 71, 72 obliquely inclined to the piston rod, which permit the obtaining of a favourable power utilisation.

In this connection it is to be observed that because of the obliquely arranged crank guide, the lower or inner dead centre point of the piston lies at 182, i.e. it progresses out of the normal position to the piston rod, so that the piston 12' no longer is situated at its lower dead centre position, but only after an alignment of the piston rod somewhat corresponding to 182. From this construction there results a modification of the stroke characteristics of the piston. Because of the inclined arrangement of the crank guide, there is produced a stroke characteristic which corresponds to the shape of a distorted Cardioid curve. It is to be understood that all modifications according to FIGS. 1 2 and 5, 6 may be comprised in such an embodiment with an engine rotor.

As an example reference is made to FIG. 10. In this figure there is shown an engine rotor 93 having four cylinder bores 94–97 which are oppositely arranged in pairs 94, 96; 95, 97, and in which working pistons 98, 99, 100, 101 are guided, which are connected by piston rods 74, 75; 72, 73 and crank guides 70, 71 in the described manner, in which engages a crank pin, 69. The cylinder bores 94–97 are according to FIG. 10 closed to the crank case by intermediate walls 102, 105, and, as is shown with reference to the cylinder space 94, the ports 106, 107, 108 lead into the cylinder spaces. These ports lead into the cylinder space 94 at such a level, with respect to the dimensions of the piston 98 above the intermediate wall 102, that the ports lead into the working chamber 109 when the piston 98 is at its inner dead centre point, whilst the ports underneath the piston lead into a compression chamber 111 when the piston is situated at its central range, i.e. is spaced from the intermediate walls 102–105. The ports 107, 108 are both intake and outlet ports and they are controlled in the manner as is described with reference to FIG. 7 by means of the slip and control rings 87, 88. FIG. 10 shows that the pistons assume various positions during the cycle. In the cylinder space 94, which is shown at the top of FIG. 10, the pistons are near to the lower or inner dead centre point. In this case also the displaced position of the dead centre point is indicated approximately at 182. In this region, corresponding to a longitudinal slot having the length of the double arrow 112, the working space 109 is connected to the exhaust, because a working stroke has been effected in the direction of rotation corresponding to the arrow 113. At a given interval therefrom the ports 106–108 are connected to the intake along a distance indicated by the double arrow 113, to which intake a source of mixture is connected so that the compression space 114 underneath the piston is filled with mixture.

In the position in which the cylinder space 96 is situated in FIG. 10, an ignition device 115 is fired in order to initiate the working stroke. It is to be understood that an ignition device 115–118 is allocated to each cylinder space. After, in a position of the cylinder space 96, the compression space 114 is filled, the latter is closed so that the mixture is compressed until, in the position of the cylinder space 94, the mixture can proceed through overflow ducts 119, 120 into the working space 109. It can be recognised that here also a scavenging effect is obtained because the outlet is open in this region corresponding to the double arrow 112, but is closed before the piston 98 closes the overflow ducts 119, 120.

FIG. 10 shows a simple embodiment of a compact element for a two stroke combustion engine with particularly favourable power characteristics, and functioning as a stabilizing gyro, contributing to the maintenance of a travelling position.

FIG. 11 shows another example of an engine rotor 121, that is to say without a stator, whose construction will however be understandable from the foregoing description. The embodiment according to FIG. 11 shows a practical form employing two essential inventive concepts, namely the design of a two stroke combustion engine as a stabilizing gyro, and energy utilization of the exhaust gas. A crank pin, corresponding to the crank pin 69 in FIG. 7, is indicated in FIG. 11 by 122. In this embodiment there are three piston rod arrangements 123, 124, 125 mutually displaced through 120°, at the centre of which there is arranged a respective crank guide 126, 127, 128 inclined to the direction of the piston rod, in which crank guide engages the crank pin 122, whilst with each crank guide 126–128 there is associated a corresponding arrow directed to the crank pin.

It is to be seen that for each piston rod 123–125 on the one hand there is arranged a working piston 129, 130, 131 of small diameter, and on the other hand a compression piston 132, 133, 134 of larger diameter. The cylinder chambers 135, 136, 137 on the one hand and 138, 139, 140 on the other hand have correspondingly dimensioned diameters. At the outer sides of the cylinder chambers there are arranged ignition devices, for example spark plugs 141, 142, 143 and 144, 145, 146. As is shown with reference to the cylinder chambers 135, 140 and the pistons 129, 134, the cylinder spaces 135 and 140 are connected by a duct 147. Corresponding ducts between other cylinder chambers are indicated by 148 and 149. The ducts are so arranged that the outlet 150 lies above the high pressure working piston 129 when the latter is situated at its inner dead centre position. The outlet port 151 leads likewise to the outer side of the piston 134 when the latter is situated in the region of the inner dead centre position.

All the cylinder spaces 135 to 140 are closed off with respect to the crank case by walls 152, 153, 154 . . . having sealed apertures 155, 156 . . . for admitting the piston rods. Thus there is formed in each case a working chamber in the cylinder spaces at the sides of the pistons 129 to 134, at which the ignition devices 141 to 145 are arranged, whilst the compression spaces are arranged at the other sides of the pistons. These compression spaces are in communication with respect to mutually associated cylinder spaces 135, 140; 136, 138; 137, 139 not only through the ducts 147 to 149, but also through the ducts 157, 158, 159 at the inner side of the pistons. Furthermore the cylinder spaces at the inner side of the pistons are connected with intakes through suction ports 160, 161 in order to suck in air, as is described only for the cylinder spaces 135, 140. The cylinder spaces at the ports 160 is connected through an overflow duct 162, having a port 163, to the cylinder space 135 in such a manner that the port 163 is released when the working piston 129 is situated at its inner dead centre point. There exists the possibility of providing a duct 166 with a controlled valve 167 between an outlet 164 of the duct 162 to the compression space at the inner side of the piston 129 and outlet ports 165 at the outwardly situated end of the cylinder space 135, in order, if necessary, to perform a unidirectional scavenging.

The cylinder spaces 138, 139, 140 have outlet ports 168 and 170, as indicated with reference to the cylinder space 140, in which case only one of the ports is arranged for reverse scavenging, namely 168, and 170 is arranged for unidirectional scavenging. The outlet ports are controlled in the aforementioned manner by slip rings. Correspondingly the working cylinder space 135 has an intake port 171, which is opened when the working piston 129 is in the region of its inner dead centre point.

With regard to the cylinder spaces 135 and 130, it is to be observed that, after ignition of the ignition device 141, the piston 129 has carried out the working stroke at the diametrally opposite position. After the working stroke the exhaust gases flow through the duct 147 into the cylinder space 140. At the same time, by opening the port 163, compressed air from the lower side of both pistons 129, 134 is fed into the cylinder space 135 for scavenging the same and is also led into the cylinder space 140. Fresh mixture is sprayed in through the port 171, which under control is open approximately in the position of the cylinder space 135. The spraying in of the fresh mixture is effected after the scavenging. In a modified embodiment it is possible for the sprayed in mixture to be additionally compressed underneath a separate cylinder and piston arrangement. Upon rotation of the engine rotor 121 the charges above the outer sides of the pistons are compressed, and upon reaching a position shown at the bottom of FIG. 11 are fired. During the compression air is again sucked in underneath the pistons, which is compressed by the inward movement of the pistons, whilst both chambers underneath the connected cylinder spaces can equalise each other. The result is obtained that a considerable quantity of air is produced for scavenging and for oxygen enrichment of the exhaust gases which are fired before being expelled.

Starting from the fact that in the case of the engine rotor 122 the opening of the ports is controlled by slip rings, it is to be observed that the exhaust port 168 is open in the range of rotation shown by the double arrow 172, so that, after the second ignition, consumed exhaust gases can again be expelled before the exhaust gases stream in from the cylinder space 135 in the upper position. The same applies for the exhaust port 170. The air intake ports 160, 161 are open corresponding to the double arrow 173 in order to suck in air at the undersides of pistons during their outward movement. The mixture intake port 171 is open for a short range of rotation in which it is positioned at the outer side of the working piston 129.

It is to be observed that, by reason of the oblique arrangement of the crank guides 126–128, the reversal point is situated substantially at the level of the upwardly inclined angle boundary line for the double arrow 173. To this are matched the distances of opening for the respectively controlled ports.

The drawings of FIG. 11 are only of a schematic nature in order to explain the operating principle in a particularly advantageous machine arrangement.

The construction having various diameters for the cylinders and pistons is particularly advantageous in this particular application because the combustion of the exhaust gas can be dimensioned by the magnitude of the space swept through by the stroke in relation to the additional supply of air, so that by this means there is obtained a particularly intensive after burning of the exhaust gas in a compression space. Although this modification has been described solely with reference to parallel situated cylinder and piston arrangements it should be understood that such a solution can be put into practice in the form of an arrangement of a plurality of pistons upon a piston rod in an axial formation, for example according to FIGS. 1 to 6, if the cylinder chambers are suitably connected and an additional spark plug is provided. In such a case also there exists the possibility of associating working chambers of different sizes by adopting a stepped construction of the cylinder spaces.

In FIGS. 12 and 13 are shown practical examples of the valves which may be provided. For example the valve arrangements indicated at 21 23 and 34 of FIG. 1 are constructed according to the type shown in FIG. 12. In a structural plate 179 there is arranged a wedge shaped valve body 180 whose upper and lower flat wall parts, which are sealed to the sides of the aperture, are provided with holes 181, 182. At the outer wall of this valve body there are secured resilient valve closing laminae 185, 186, these being held above and below the wall portions by means of clamping devices 183, 184 exerting a bias towards the valve body 180. The spring bias is indicated by the arrows in the drawing. The valve closes or opens according to whether a suction or pressure effect occurs in the direction of the double arrow 187.

FIG. 13 shows another known valve construction with a conical shaped plate valve in a seating 189. The spindle 191 of the valve 188, mounted in an aperture 190, is stressed by the spring 192 in such a manner that the valve body is drawn against its seating. By the application of pressure or a suction effect at one side of the valve the valve is closed or opened, or vice versa, according to the side of the valve at which the effect is applied.

I claim:

1. A two-cycle internal combustion engine comprising a working cylinder, a working piston operating within said working cylinder, a combustion chamber defined within said working cylinder on one side of said working piston, a partition wall forming a side of said working cylinder, a first compression chamber defined between the opposite side of said working piston and one side of said partition wall, a piston rod connected with said working piston and extending through said partition wall, a compression piston connected with said piston rod on the side of said partition wall opposite said first compression chamber, a second compression chamber defined between one side of said compression piston and said opposite side of said partition wall, exhaust gas outlet means for exhausting gas from said combustion chamber, first inlet means communicating through a first inlet port with said second compression chamber for supplying air thereto, first valve means between said first inlet means and said first port for enabling air flow toward said second compression chamber but blocking flow in a reverse direction, first conduit means extending in flow communication from a point between said first valve means and said first port to said exhaust gas outlet means for supplying air from within said second compression chamber to said exhaust gas outlet means, second valve means enabling air flow in said first conduit means toward said exhaust gas outlet means, but preventing flow in the reverse direction, second inlet means communicating through a second port with said first compression chamber, third valve means between said second port and said second inlet means for enabling flow toward said first compression chamber but preventing flow in a reverse direction, second conduit means extending in flow communication from a point between said second port and said third valve means to said combustion chamber and air-fuel mixture supply means for supplying a combustible mixture to said second inlet means, with compressed combustible mixture being supplied through operation of said working piston from said first compression chamber to said combustion chamber, and with compressed air being supplied by operation of said compression piston from said second compression chamber to said exhaust gas outlet means.

2. An engine according to claim 1 including a third compression chamber defined on a side of said compression piston opposite said second compression chamber, and third conduit means extending from between said second port and said third valve means to said third compression chamber to supply by operation of said compression piston combustible mixture to said combustion chamber together with said combustible mixture supplied from said first compression chamber.

3. An engine according to claim 1 wherein said working piston is reciprocally movable between a top dead center position and a bottom dead center position and wherein said second conduit means is arranged to communicate with said combustion chamber at a point immediately above said working piston when said piston is at said bottom dead center position.

4. An engine according to claim 3, wherein said exhaust gas outlet means is arranged in flow communication with said combustion chamber at a point immediately above said working piston when said piston is at said bottom dead center position.

5. An engine according to claim 2, wherein said third compression chamber is defined by the crankcase of said engine.

6. An engine according to claim 1, wherein said second conduit means and said exhaust gas outlet means communicate with said combustion chamber at the same level relative to the stroke of said working piston.

7. An engine according to claim 1, wherein spark ignition means is provided in said exhaust gas outlet means.

* * * * *